US007428950B2

(12) United States Patent
del Rio et al.

(10) Patent No.: US 7,428,950 B2
(45) Date of Patent: Sep. 30, 2008

(54) LOW OVERHEAD MACHINE ROOMLESS ELEVATOR CONFIGURATION

(75) Inventors: Fernando del Rio, Torrelodones (ES); Andres Monzon, Leganes (ES); Jose Canales, Madrid (ES); Julian Cabanas, Madrid (ES); Jose Caballero, Madrid (ES); Leandre Adifon, Farmington, CT (US)

(73) Assignee: Otis Elevator Company, Farmington, CT (US)

( * ) Notice: Subject to any disclaimer, the term of this patent is extended or adjusted under 35 U.S.C. 154(b) by 395 days.

(21) Appl. No.: 10/560,259

(22) PCT Filed: Jun. 12, 2003

(86) PCT No.: PCT/US03/18523

§ 371 (c)(1),
(2), (4) Date: Dec. 9, 2005

(87) PCT Pub. No.: WO2005/005301

PCT Pub. Date: Jan. 20, 2005

(65) Prior Publication Data

US 2006/0144642 A1 Jul. 6, 2006

(51) Int. Cl.
*B66B 11/08* (2006.01)

(52) U.S. Cl. ..... 187/254; 187/277; 187/414

(58) Field of Classification Search ..... 187/250, 187/251, 252, 254, 256, 262, 266, 404, 407, 187/411, 277, 414
See application file for complete search history.

(56) References Cited

U.S. PATENT DOCUMENTS

| | | | | |
|---|---|---|---|---|
| 1,676,449 | A | 7/1928 | Lederer | |
| 5,469,937 | A * | 11/1995 | Hakala et al. | 187/266 |
| 6,247,557 | B1 * | 6/2001 | Kobayashi et al. | 187/266 |
| 6,305,499 | B1 | 10/2001 | Jones et al. | |
| 6,382,360 | B2 | 5/2002 | Kobayashi et al. | |
| 6,488,124 | B1 * | 12/2002 | Yasuda et al. | 187/254 |
| 2002/0017434 | A1 | 2/2002 | Orrman et al. | |
| 2002/0070080 | A1 | 6/2002 | Nakagaki et al. | |
| 2003/0155185 | A1 | 8/2003 | Nomura et al. | |

FOREIGN PATENT DOCUMENTS

| | | |
|---|---|---|
| CN | 1337916 A | 2/2002 |
| DE | 10154171 | 5/2003 |
| GB | 2 383 791 A | 7/2003 |
| JP | 2002167137 | 6/2002 |
| WO | 0044664 | 8/2000 |
| WO | 02090232 A1 | 11/2002 |

* cited by examiner

*Primary Examiner*—Jonathan Salata
(74) *Attorney, Agent, or Firm*—Carlson, Gaskey & Olds

(57) ABSTRACT

A drive arrangement for an elevator car and a machine roomless elevator incorporates a machine (26) having a drive sheave (27) extending along an axis parallel to the axes of the deflection sheaves (23, 25) associated with both the counterweight (24) and the elevator car (22). In this manner, the twisting which has occurred in the prior art is reduced or eliminated. The machine is mounted on a bedplate (18) between the guide rails. The elevator car is preferably cantilever mounted, and mounted on laterally outer surfaces of said guide rails. In this manner, the elevator car can travel vertically upwardly beyond the machine.

12 Claims, 3 Drawing Sheets

LOW OVERHEAD MACHINE ROOMLESS ELEVATOR CONFIGURATION

BACKGROUND OF THE INVENTION

This application relates to a unique placement of the elevator machine and the associated sheaves, and a unique mounting of the elevator car that results in a very low overhead space requirement.

Elevators typically include a car guided for vertical movement within an elevator hoistway. Typically, a machine drives a rope or belt around a number of sheaves to connect and drive an elevator car and a connected counterweight. Historically, the machine was mounted in a room above the elevator hoistway. Thus, a good deal of additional space was required above the hoistway, which was undesirable.

More recently, so-called "machine roomless" elevators have been designed. In such constructions, the machine is incorporated in a small space in the elevator hoistway. A separate room has not been required.

Typically, known machine roomless elevators have included sheaves that are non-parallel relative to each other, and relative to the drive sheave associated with the machine. This non-parallel configuration has been necessary to pass the belt or rope over the several sheaves within the small envelope of space typically available. While machine roomless elevators are becoming more widely utilized, a complication is that non-parallel sheaves has sometimes resulted in twisting of the rope or belt. Moreover, non-parallel sheaves make it more difficult to move to newer types of belts such as very slim line belts. Twisting of such belts is even more detrimental than it is to traditional ropes or belts.

In addition, one type of mount for an elevator car is a cantilever mount. In a cantilever mount, the car is mounted to guide structure at one side. The cantilever mount typically has been mounted on guide rails, through mount structure that is laterally between the guide rails. More recently, it has been proposed to mount the elevator car to the laterally outward side of the guide rails.

SUMMARY OF THE INVENTION

In the disclosed embodiment of this invention, a machine is mounted to the bedplate of an elevator, and between the guide rails. Thus, the elevator is a so-called machine roomless elevator. The deflection sheaves associated with both the counterweight and the car, along with the drive sheave associated with the machine, all extend along parallel axes. Due to this, the likelihood of twisting is greatly reduced. Thus, more modern drive connections such as very thin belts may be utilized.

These and other features of the present invention can be best understood from the following specification and drawings, the following of which is a brief description.

DETAILED DESCRIPTION OF THE PREFERRED EMBODIMENTS

Figure 1:
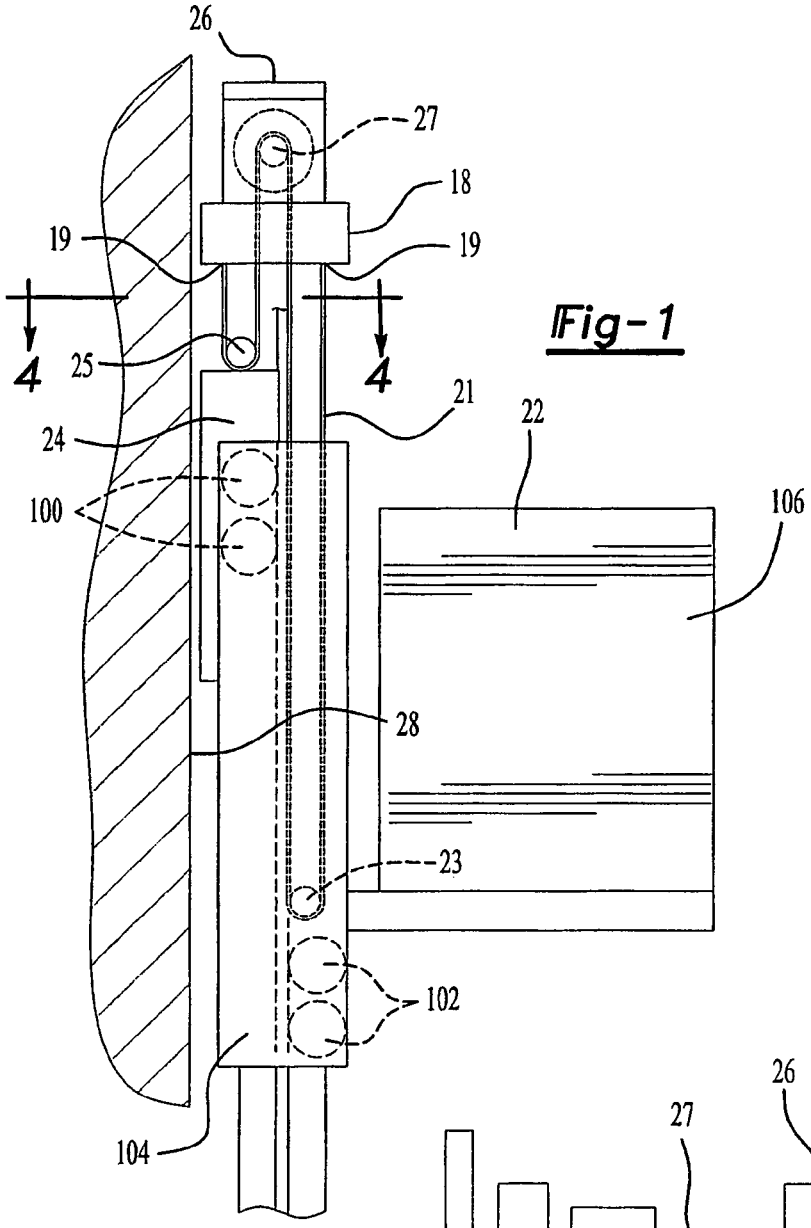
FIG. 1 shows an elevator car at an intermediate position of travel.

An elevator 20 is illustrated in FIG. 1 having a car 22 movable vertically upwardly and downwardly along a hoistway. A deflection sheave 23 is mounted to receive a guide rope 21 and move the car 22 vertically upwardly and downwardly. The rope 21 is attached to dead end hitches 19 on the bedplate 18 at each of its ends. Intermediate the dead end hitches, the rope 21 passes over the deflection sheave 23, a deflection sheave 25 associated with the counterweight 24, and a sheave 27 associated with the drive machine 26. As can be appreciated from this rather schematic view, the sheaves 23, 25 and 27 all extend along parallel axes, and all are within a very small space away from the wall 28 of the hoistway. The sheaves 23, 25 and 27 are also generally axially aligned along the parallel axes. The parallel axes and axial alignment ensure that all of the rope drops are substantially vertical. For a simplified understanding of this invention, only a single rope and a single set of sheaves 23, 25 and 27 have been illustrated. However, in practice, there are typically several sets of sheaves and ropes. The use of the parallel axes and axial alignment provided by this invention ensures that all of the rope drops may be substantially vertical.

As can be seen in FIG. 1, rollers 100 and 102 move with the elevator car. Guide structures, such as guide shoes, may be used rather than rollers. These rollers will guide the car 22 along guide rails, as will be explained below. As can further be appreciated, the elevator car 22 includes what might be called a cabin 106 and a frame 104. The frame 104 is between the cabin and the wall 28. The deflection sheave 23 is mounted on the frame 104, and inwardly from the cabin 106.

Figure 2:
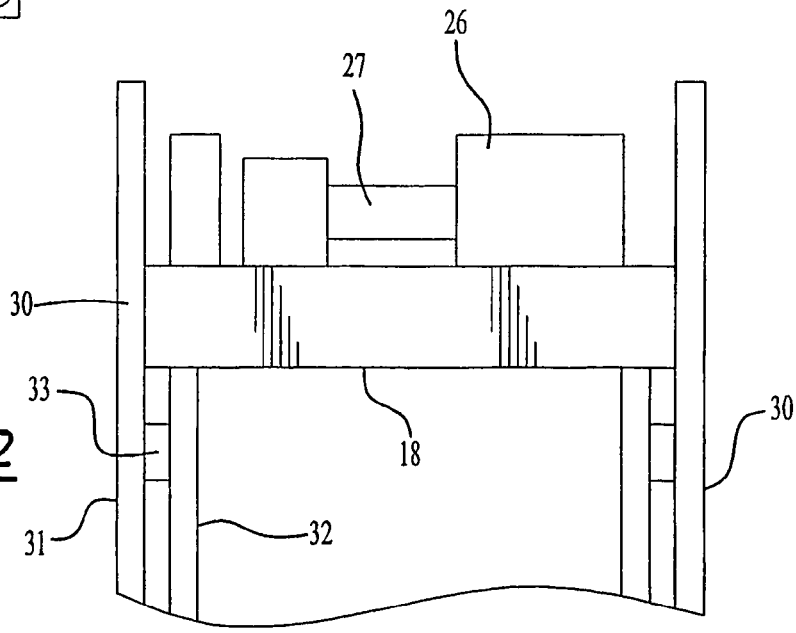
FIG. 2 is a detailed view of the guide and drive structure for the elevator car of FIG. 1.

As shown in FIG. 2, the drive sheave 27 is associated with the machine or drive motor 26 and mounted on the bedplate 18. Although not shown in FIG. 1 or 5, guide rails 30 are mounted at each opposed lateral side of the bedplate 18, and extend along the hoistway. The guide rails 30 actually include a pair of opposed guide rails 31 and 32, with rail 31 being laterally outwardly and rail 32 being laterally inwardly. The guide rails 31 and 32 are periodically connected by a cross member 33. Cross member 33 also serves to connect guide rails 31 and 32 to wall 28.

Figure 3:
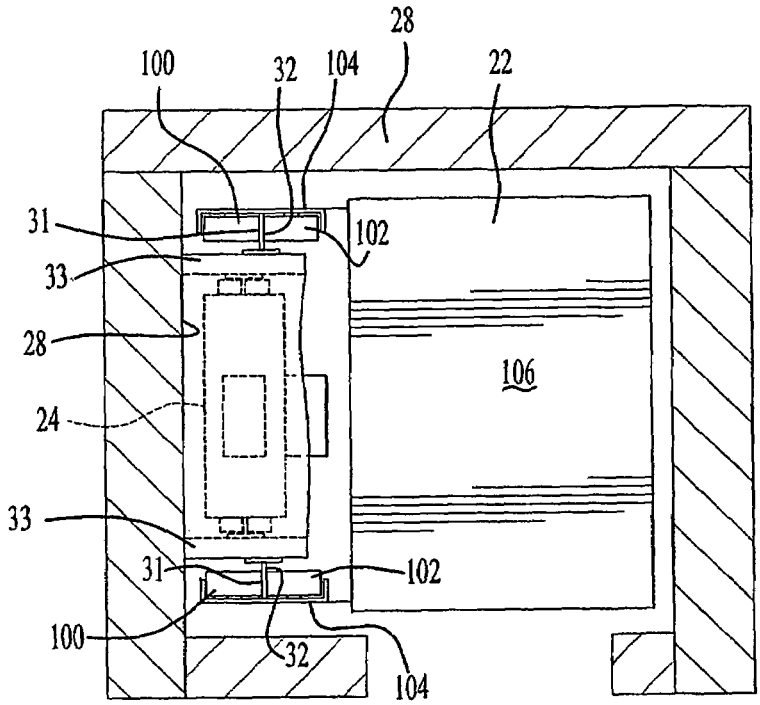
FIG. 3 is a top view of the structure illustrated in FIG. 2.

As shown in FIG. 3, the guide rail 31 receives rollers 100 and 102 from the car 22. As can be appreciated, the car 22 is thus cantilever mounted at one side, and connected on guide rails at the laterally outer surface. The guide structure is intended to be schematic.

Figure 4:
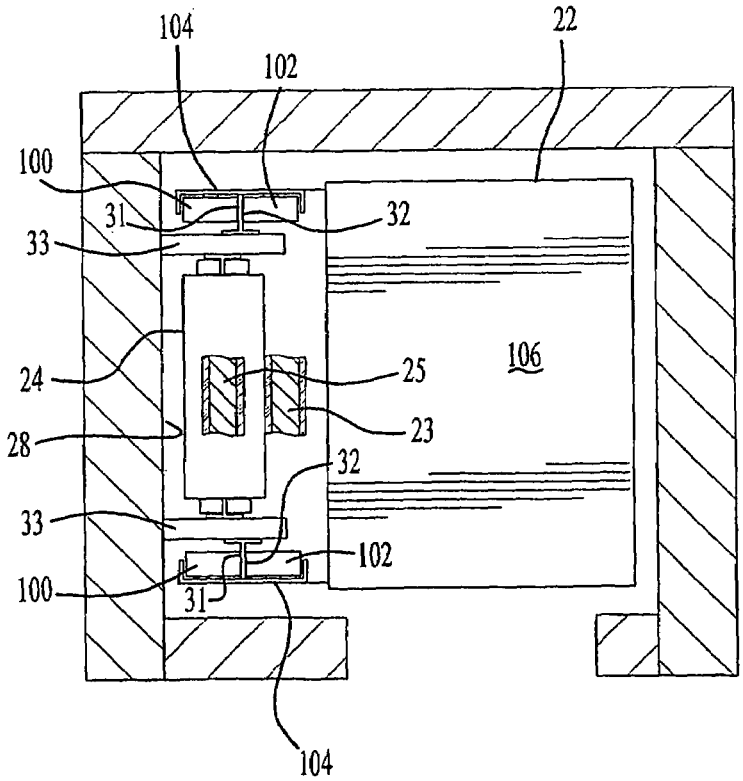
FIG. 4 is a cross-sectional view roughly along line 4-4 as shown in FIG. 1.

As shown in FIG. 4, the counterweight 24 is mounted on the inner rails 32. As is also clear from this schematic view, the sheaves 23 and 25 are also parallel.

As can be appreciated from FIGS. 3 and 4, the guide rails 31 and 32 are preferably not a single structure, but instead are two separate rails. The rails may be positioned at various locations. As can be appreciated from this figure, the rail 32 for the counterweight 24 is positioned closer to wall 28 than is the rail 31 for the car 22. This also allows the efficient use of space, and ensures that there is not an undue amount of required space between the wall 28 and the car 22. Of course, this invention extends to the use of combined car and counterweight guide rails.

Figure 5:
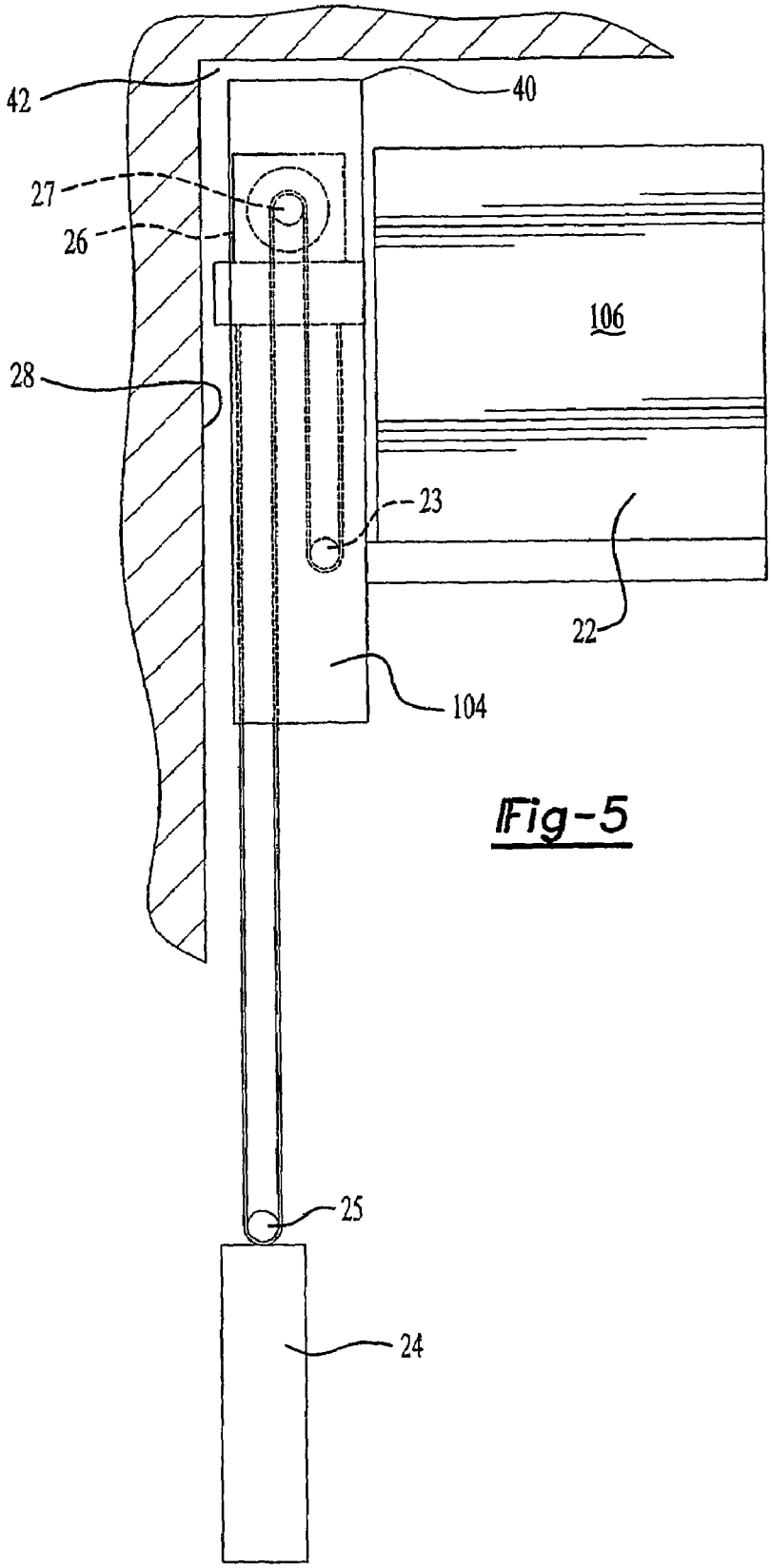
FIG. 5 shows the elevator car at a vertically uppermost position.

As shown in FIG. 5, the car 22 has now moved to its vertically uppermost position. The vertically uppermost part 40 of the car is vertically beyond the machine 26. Thus, the amount of space 42 required above the vertically uppermost part 40 of the car is very small compared to the prior art.

Although a preferred embodiment of this invention has been disclosed, a worker of ordinary skill in this art would recognize that modifications would come within the scope of this invention. For that reason, the following claims should be studied to determine the true scope and content of this invention.

We claim:

1. An elevator system including an elevator car movable within a hoistway comprising:

a machine for driving an elevator car through a hoistway;

a counterweight mounted in the hoistway and having a deflection sheave;

an elevator car mounted for movement in the hoistway and having a deflection sheave; and said machine having a drive sheave, said drive sheave, and said deflection sheaves all having parallel axes of rotation, wherein said drive sheave axis and said deflection sheave axes are parallel to an outer wall of said car, and a connecting member passing over said deflection sheaves and said drive sheave to drive said counterweight and said car within the hoistway, said machine mounted in the hoistway, and in a space between said car and a wall defining the hoistway, such that said machine is not directly above said car, said car being movable within the hoistway such that it is at least partially vertically aligned with said machine when in a vertically uppermost position.

2. An elevator system as set forth in claim 1, wherein there are a pair of opposed guide rails for guiding an elevator car, said guide rails being mounted at opposed longitudinal ends of an axis of rotation of said drive sheave.

3. An elevator system as set forth in claim 1, wherein said deflection sheave associated with said elevator car is positioned between an outer edge of a cabin for receiving passengers in said car, and the wall which will define the hoistway.

4. An elevator system as set forth in claim 1, wherein said drive sheave and said deflection sheaves all are at generally equal axial positions along their respective parallel axes of rotation.

5. An elevator system as set forth in claim 2, wherein said machine is mounted to said opposed guide rails.

6. An elevator system as set forth in claim 5, wherein a bedplate connects said opposed guide rails and said machine is mounted on said bedplate.

7. An elevator system as set forth in claim 6, wherein said connecting member is connected to a dead end hitch at each of two opposed ends and on said bedplate.

8. An elevator system as set forth in claim 5, wherein said elevator car is cantilever mounted from said guide rails.

9. An elevator system as set forth in claim 8, wherein said guide rails have guiding surfaces at longitudinally outer sides and said elevator car is connected on said outer guide surfaces.

10. An elevator system as set forth in claim 9, wherein said counterweight is guided on longitudinally inner guide rails.

11. An elevator system as set forth in claim 10, wherein said guide rails for said counterweight are positioned to be closer to a wall than said guide rails for said elevator car.

12. An elevator system as set forth in claim 9, wherein said elevator car has a vertically uppermost point of travel which is vertically above said machine.

* * * * *

UNITED STATES PATENT AND TRADEMARK OFFICE

CERTIFICATE OF CORRECTION

PATENT NO. : 7,428,950 B2
APPLICATION NO. : 10/560259
DATED : September 30, 2008
INVENTOR(S) : del Rio et al.

It is certified that error appears in the above-identified patent and that said Letters Patent is hereby corrected as shown below:

ON THE TITLE PAGE: Item (75) Inventors:

The 3rd Inventor's information should read as follows:

--Jose Canales, Majadahonda (ES)--.

Signed and Sealed this

Seventeenth Day of August, 2010

David J. Kappos

David J. Kappos
*Director of the United States Patent and Trademark Office*